US005225870A

United States Patent [19]

Tanimoto et al.

[11] Patent Number: 5,225,870

[45] Date of Patent: Jul. 6, 1993

[54] IMAGE FORMING APPARATUS HAVING A DETECTOR FOR A MOUNTING UNIT

[75] Inventors: Yasufumi Tanimoto, Fujisawa; Takashi Saitoh, Tokyo, both of Japan

[73] Assignee: Kabushiki Kaisha Toshiba, Kawasaki, Japan

[21] Appl. No.: 790,524

[22] Filed: Nov. 12, 1991

[30] Foreign Application Priority Data

Nov. 29, 1990 [JP] Japan ..... 2-333027

[51] Int. Cl.[5] ..... G03G 15/00

[52] U.S. Cl. ..... 355/200; 355/219

[58] Field of Search ..... 355/200, 210, 211, 219

[56] References Cited

U.S. PATENT DOCUMENTS 3,976,371 8/1976 Moser et al. ..... 355/200
4,305,651 12/1981 Umezawa et al. ..... 355/219
4,585,327 4/1986 Suzuki ..... 455/211
4,803,521 2/1989 Honda ..... 355/210 X
4,851,875 7/1989 Tanimoto ..... 355/211 X
4,952,974 8/1990 Mori ..... 355/200
4,978,995 12/1990 Takahashi ..... 355/211 X

FOREIGN PATENT DOCUMENTS 0282760 11/1988 Japan ..... 355/200

*Primary Examiner*—A. T. Grimley
*Assistant Examiner*—Robert Beatty
*Attorney, Agent, or Firm*—Foley & Lardner

[57] ABSTRACT

An image forming apparatus including a photosensitive drum, a discharging device for discharging an electric charge on the photosensitive drum, a process unit detachably provided in a main body of the apparatus, a driving circuit for driving the discharging device, a detecting circuit for detecting a driving current when the discharging device is driven by the driving circuit, and a determining portion for determining a mounting state and the suitability of the process unit in the main body of the apparatus. Therefore, suitability of the process unit and attachment to the main body of the apparatus is electrically determined.

8 Claims, 9 Drawing Sheets

IMAGE FORMING APPARATUS HAVING A DETECTOR FOR A MOUNTING UNIT

BACKGROUND OF THE INVENTION

1. Field of the Invention

The present invention relates to an image forming apparatus, and in particular to a laser printer having a pre-exposing apparatus.

2. Description of the Related Art

In a conventional laser printer, an electronic photo process unit is formed by uniting parts of the electronic photo process components such as the photosensitive drum, the charging apparatus, a developing apparatus, a pre-exposing apparatus, and a cleaning apparatus, which are independently detachable from a main body of the printer. This is because, for example, the photosensitive drum becomes used up, and must be replaced. Moreover, the cleaning apparatus for cleaning the photosensitive drum is filled with toner within a fixed period of times and the entire cleaning apparatus must be replaced with a new one. These replacements must be performed by a user and the replacement method must be simple and free from errors.

Generally, in order to detect the presence of the detachable electronic photo process unit, which is mounted in the main body of the apparatus, a switch is provided in the main body side, or a charging output of the charging apparatus is detected.

However, if the presence of the electronic photo process unit is detected by the switch, the provision of the switch itself increases costs. Also, there is a problem in reliability of an actuator, which performs the ON/-OFF operation of the switch, when the attaching and detaching operations of the unit are repeated. Moreover, if the presence of the electronic photo process unit is discriminated by detecting the charging output, an unfavorable influence is exerted on the photosensitive drum since charging must be performed when the unit is mounted on the main body.

In this type of laser printer, the specifications must be changed, depending on the customer of the OEM (original equipment manufacturing). Due to this, in a conventional apparatus, specific mechanism connecting sections in the main body of the apparatus, the process unit and the connecting section are modified for each customer (or each type of apparatus). However, if the shape of the connecting section is changed for each customer, manufacturing costs increase. Moreover, in a conventional apparatus, when a plurality of switches are provided in the apparatus and the unit is mounted thereon, binary data is generated, thereby the mount of the unit and the type are discriminated. In this case, additional I/O ports are needed, and manufacturing costs again increase.

SUMMARY OF THE INVENTION

An object of the present invention is to provide an image forming apparatus which can detect the mounting state of a unit on a main body of the apparatus with high reliability and by a low price.

In order to attain the above object, there is provided an image forming apparatus comprising a process unit, detachably provided in a main body of the apparatus, having an image carrier member and discharging means for discharging the surface of the image carrier member; supply means for supplying a driving current for driving said discharging means; detecting means for detecting said driving current supplied to said discharging means by said supply means; and discriminating means for discriminating that said process unit is attached to said main body of the apparatus when it is detected that said driving current is supplied from said supply means to said discharging means by said detecting means.

According to the present invention, since the mounting state of the unit on the main body of the apparatus can be electrically detected without providing a special switch and exerting unfavorable influence on another part of the unit, reliability of detecting the mounting state can be greatly improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

An embodiment of the present invention will be explained with reference to the drawings.

Figure 1:
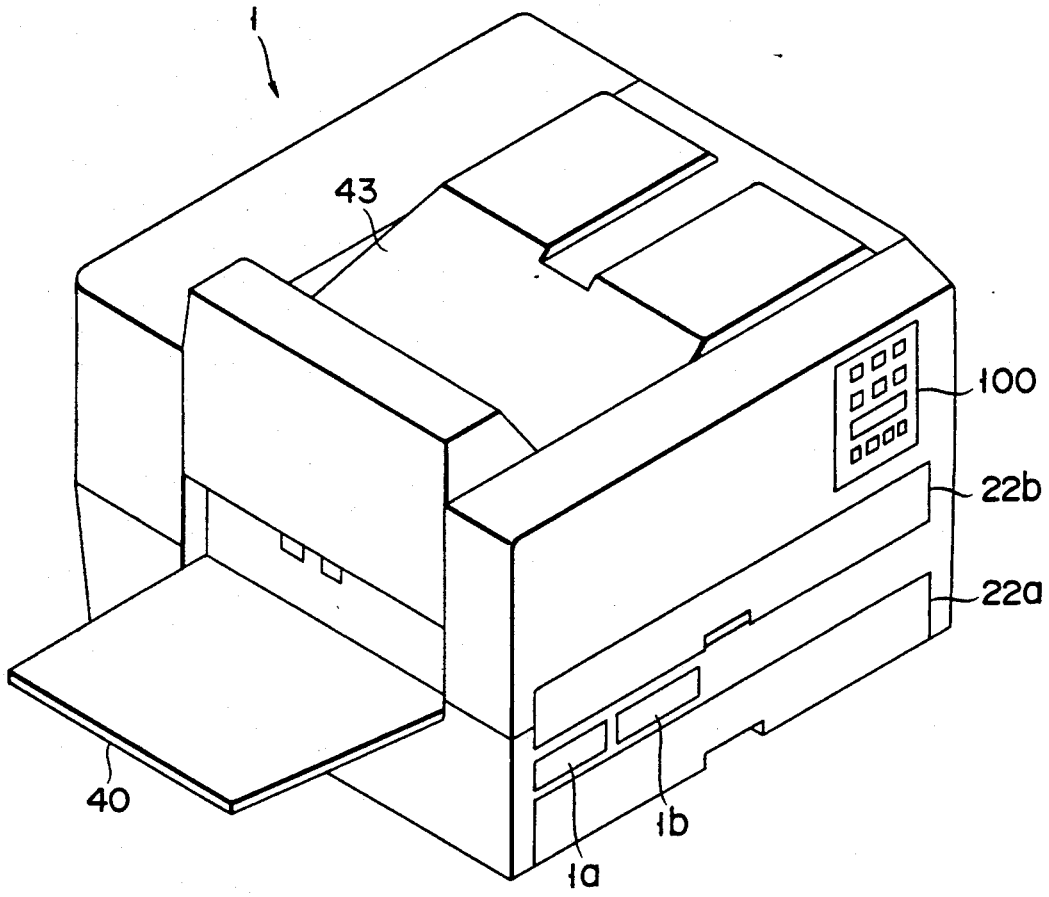
FIG. 1 is a perspective view of a laser printer showing one example of an image forming apparatus.
Figure 2:
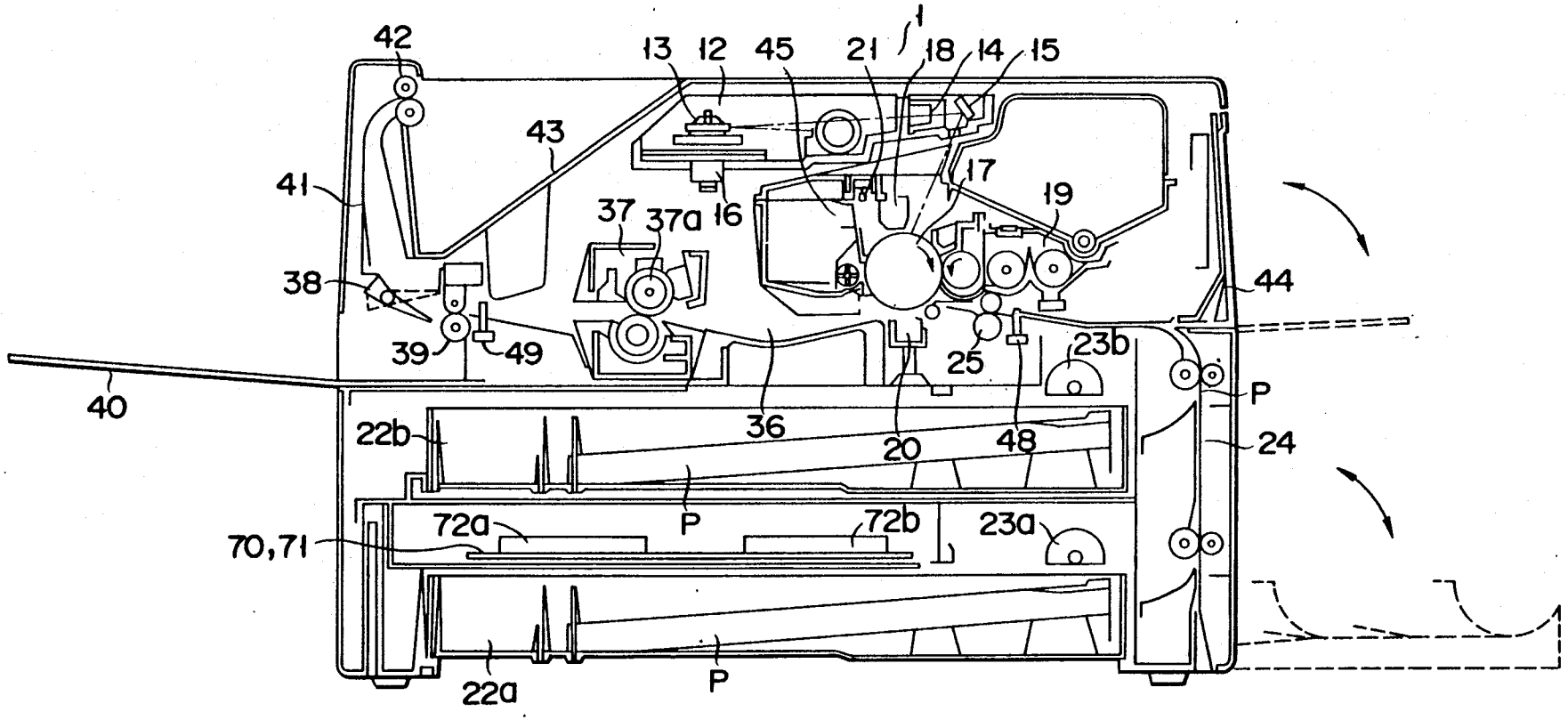
FIG. 2 shows an inner structure of the laser printer shown in FIG. 1.

FIGS. 1 and 2 show an image forming apparatus of the present invention such as a laser printer.

More specifically, in a main body 1 of the laser printer, there are provided a laser optical system 12 as a latent image forming means, a photosensitive drum 17 as an image carrier member, a charging apparatus 18 comprising a scorotron, a developing apparatus 19 as a developing means, a transferring apparatus 20 comprising a corotron, a pre-exposing apparatus 21, formed of a plurality of tungsten lamps connected in series, as discharging means, a fixing apparatus 37, a process system, such as a cleaning apparatus 45, paper feeding cassettes **22*a*, 22*b*, delivering rollers 23*a*, 23*b*, a pair of aligning rollers 25, a transferring guide 36, a gate 38, a pair of paper discharging rollers 39, 42**.

The laser optical system 12 comprises a semiconductor laser oscillator (not shown) for generating a laser beam, a collimator lens (not shown) for correcting the laser beam from the oscillator to be a parallel light, a polygon mirror 13 (rotating mirror) having octahedral faces reflecting the laser beam from the lens above every scanning line, an f . θ lens 14, a mirror 15, and a mirror motor 16 rotating (driving) the polygon mirror 13.

At the time of the image forming operation, the laser beam, which corresponds to an image signal from an external equipment (not shown) and an input signal from an operation panel 100, from the laser optical system 12 is focused on the surface of the photosensitive drum 17.

The photosensitive drum 17 is rotated in a direction of the arrow (shown). After a surface potential is maintained constant by the pre-exposing apparatus 21, the surface is evenly charged by the charging apparatus 18. Thereafter, exposure is performed by the laser optical system 12. In other words, the laser beam emitted from the semiconductor laser oscillator is scanned at a constant speed from the left direction of the photosensitive drum 17 to the right direction in accordance with the rotation of the polygon mirror 13 due to the mirror motor 16. Thereby, an electrostatic latent image, which corresponding to the image signal, is formed on the surface of the photosensitive drum 17. The electrostatic latent image is visualized as an toner image (developer image) toner is adhered to the photosensitive drum by the developing apparatus 19.

On the other hand, paper P as image forming medium stored in the paper feeding cassettes 22*a* and 22*b* is taken out one by one by the delivering rollers 23*a* and 23*b*, and guided to the pair of the aligning rollers 25 through a paper guiding passage 24, and sent to a transferring section by the pair of aligning rollers 25.

More specifically, paper P, which is supplied from a manual paper feeding section 44 and guided to the pair of the aligning rollers 25, is sent to the transferring section in accordance with a designation sent from the external equipment or the operation panel 100.

After imaging the toner image, paper P sent to the transferring section is firmly attached to the surface of the photosensitive drum 17, and the toner image on the photosensitive drum 17 is transferred to paper P by the transferring apparatus 20. The transferred paper P is separated from the photosensitive drum 17 and sent to the fixing apparatus 37 through the transferring guide 36. By passing through the transferring guide 36, the transfer image is thermally fixed by a heat roller 37*a* for generating fixing heat. A heater lamp (not shown) is built in the heat roller 37*a*.

After fixing, paper P is sent onto a paper discharging tray 40 through the gate 38 by the pair of paper discharging rollers 39 or sent to a transferring passage 41 by the gate 38, and discharged on a paper discharging tray 43 by the paper discharging rollers 42.

After residual toner is removed from the transferred photosensitive drum 17 by the cleaning apparatus 45, an after-image is erased by the pre-exposing apparatus 21. Thereby, there is obtained a state that the following image forming operation can be performed.

Figure 3:
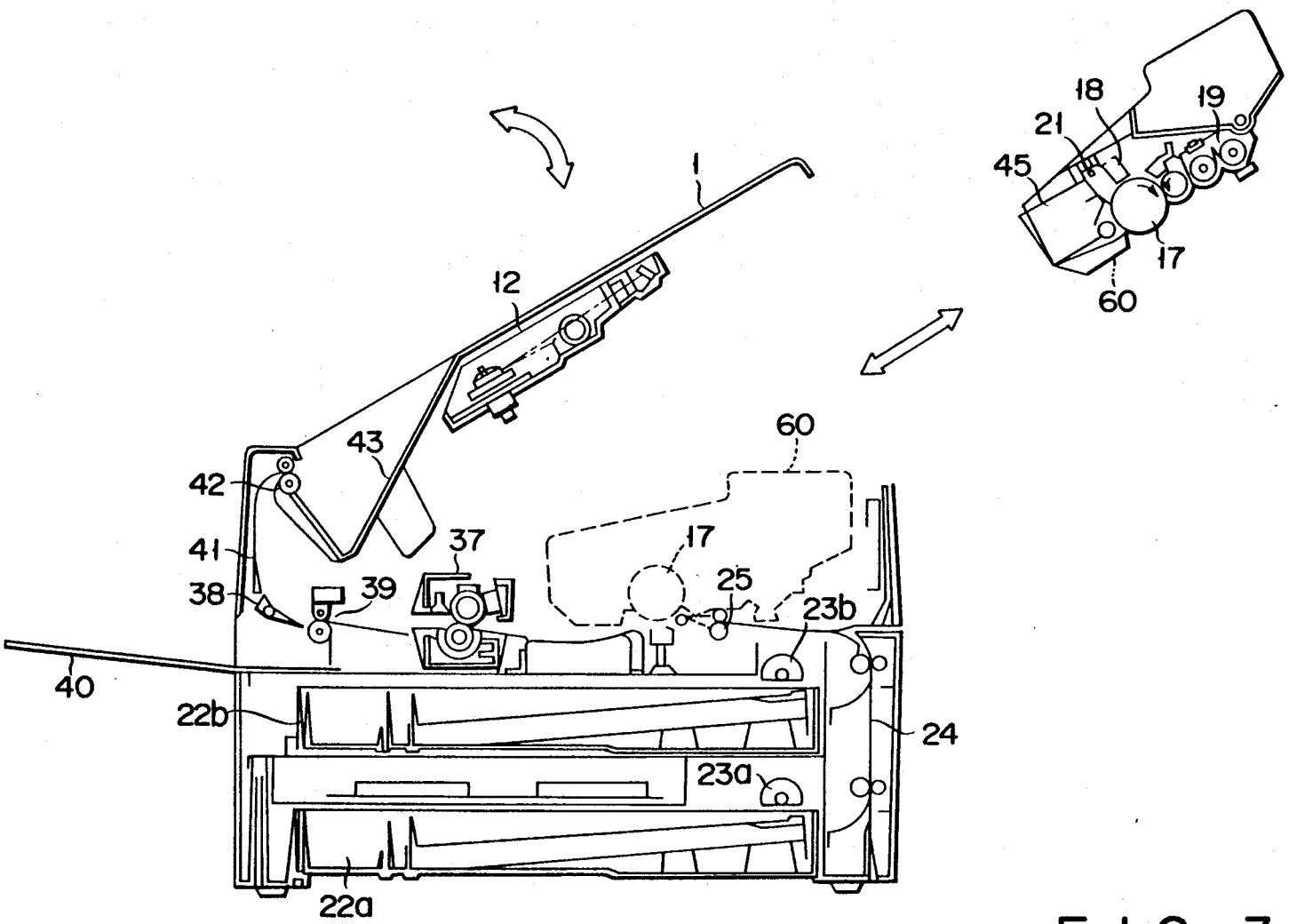
FIG. 3 shows a state that a process unit is attached/-detached to/from a main body of the apparatus.

As shown in FIG. 3, an electronic photo process unit 60, in which the photosensitive drum 17, the charging apparatus 18, the developing apparatus 19, the preexposing apparatus 21, and the cleaning apparatus 45 are unified, can detachably mounted on the main body 1 of the apparatus.

In front of the pair of aligning rollers 25, there is an aligning switch 48 for detecting any paper feeding error to the transferring section caused by the pair of the aligning rollers 25. Also, in front of the pair of the paper discharging rollers 39, there is provided a paper discharging switch 49 for detecting errors in paper discharging caused by the pair of the paper discharging rollers 39.

Moreover, between the paper feeding cassettes 22*a* and 22*b*, there are provided an engine control section (to be explained later), which controls each electrical apparatus provided in the main body 1 and mounts an engine control circuit 70 for controlling the operation for completing the electronic photo process thereon, and a substrate (printer control section) on which a printer control circuit 71, for controlling the operation of the engine control circuit 70, is mounted.

The maximum number of substrates of the printer control circuit 71, which can be mounted, is up to three depending on the degree of the additional functions for example, kinds of writing style, and "Kanji" (Japanese ideograms) are increased). Also, an IC card (to be explained later) for adding functions is inserted into two IC card connectors 72*a* and 72*b*, which are formed in a front edge portion of the substrate of the printer control circuit 71 positioned at the lowest stage, via openings 1*a* and 1*b* of the main body 1, thereby more functions can be further added.

On the right end surface of the substrate of the printer circuit 71 positioned at the lowest stage, there is arranged a connector (not shown) connecting to a host apparatus (to be explained later), which is an external apparatus such as an electronic computer or a word processor.

The structure of the engine control section will be explained.

Figure 4:
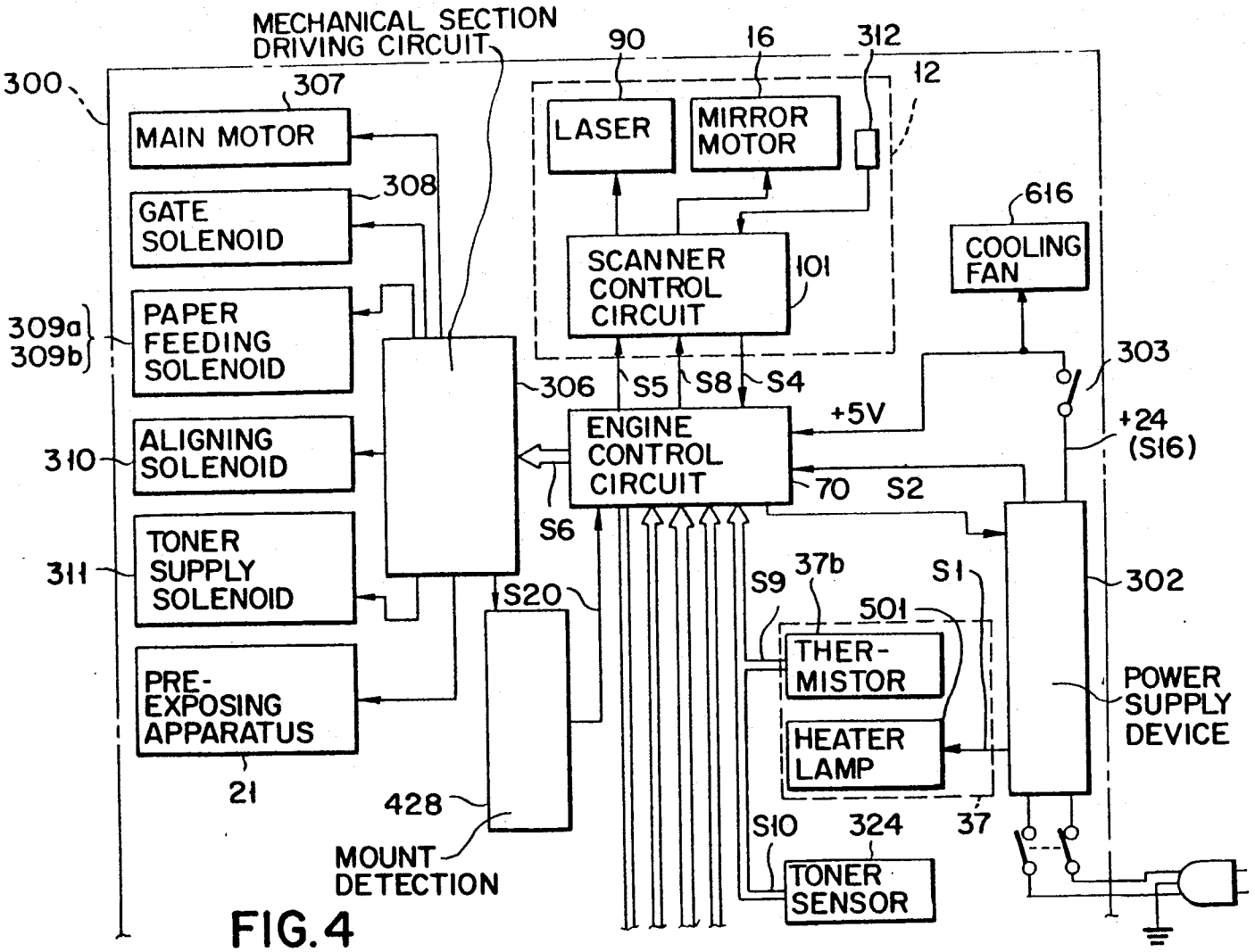
FIG. 4 is a block diagram showing the main part of the structure of an engine control section.
Figure 4:
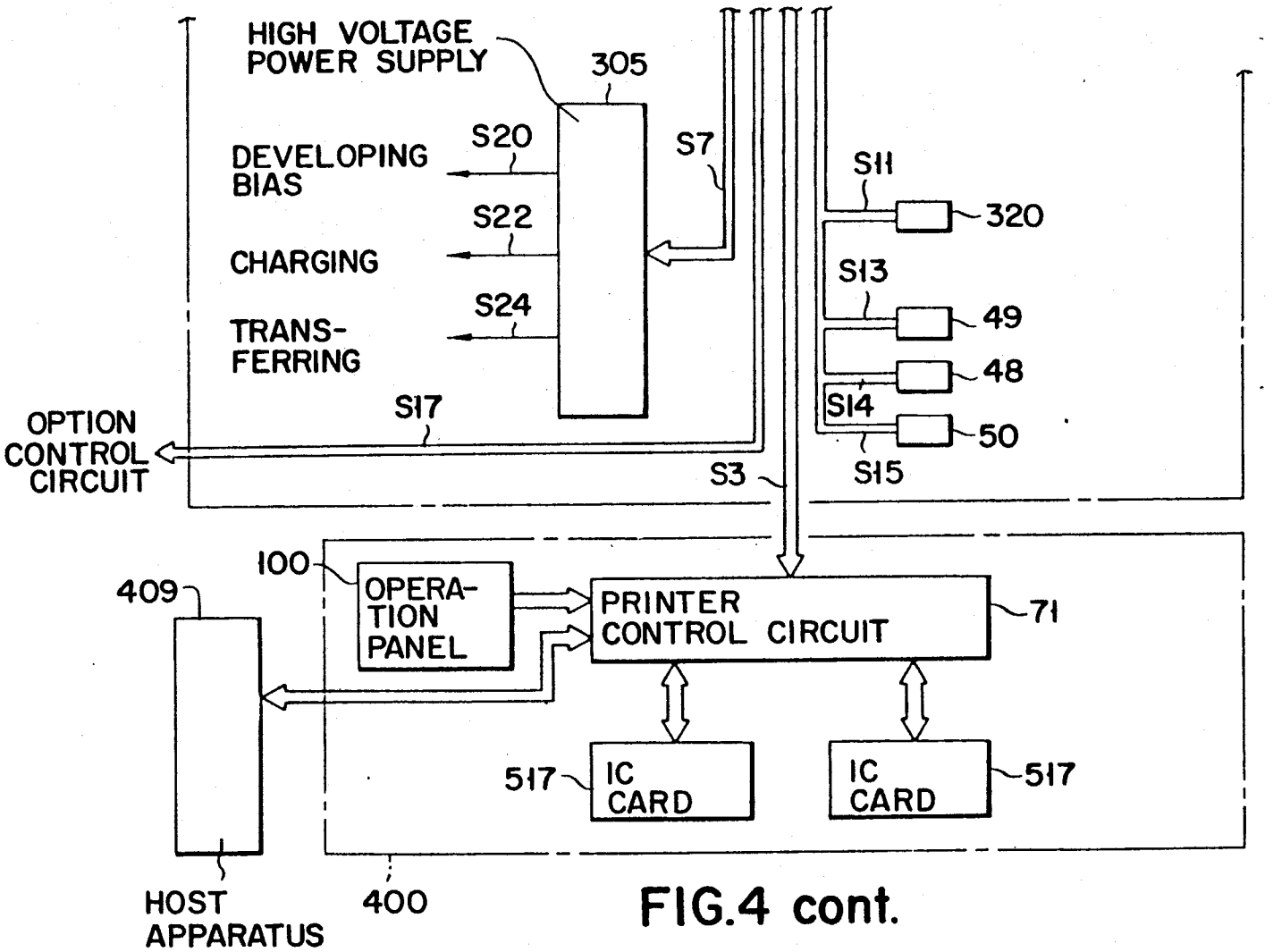

FIG. 4 is the structure of the main part of the engine control section 300.

In the drawing, reference numeral 302 is a power supply device, and outputs power supply voltages +5V and +24V by turning on a main switch 301.

The power supply voltage of +5V is supplied to the engine control circuit 70, and further supplied to the printer control circuit 71 via the engine control circuit 70.

On the other hand, the power supply voltage of +24V is supplied to the engine control circuit 70 and a cooling fan 616 via a cover switch 303. Then, the current from the power supply voltage is supplied to the scanner control circuit 101, the high voltage power supply 305, and the mechanical section driving circuit 306 via the engine control circuit 70, respectively.

These power supplies are supplied through the scanner control circuit 101 to a semiconductor laser 90 and a mirror motor 16, and through the mechanical section driving circuit 306 to a pre-exposing apparatus 21, a main motor 307, a gate solenoid 308, a paper feeding solenoids 309*a*, 309*b*, an aligning solenoid 310, a toner supply solenoid 311, and a mount detection section 428 detecting the mount of the electron photo process unit 60 and its suitability for the apparatus, respectively. These power supplies are used as a driving power source for these elements. For example, the paper feeding solenoid 309*a* is turned on, thereby the delivering roller 23*a* makes one rotation and one paper P is taken out from the paper feeding cassette 22*a*. Moreover, the paper feeding solenoid 309*b* is turned on, thereby the delivering roller 23*b*makes one rotation and one paper P is taken out from the paper feeding cassette 22*b*.

In the power supply device 302, there is provided a heater lamp driving circuit (not shown) of zero cross switch system, which comprises a photo TRIAC coupler and a TRIAC, for driving a heater lamp 501 in the fixing apparatus 37, the power supply voltage of +24V is used as driving power supply of LED of the photo TRIAC coupler.

In the above-structured heater lamp driving circuit, as is known, if the LED is turned on/off, the photo TRIAC on the light emitting side is turned on/off at a zero cross point of the AC power supply. Thereby, the TRIAC, which is a main element of the next stage, is turned on/off, so that an AC power supply S1 is supplied to the heater lamp 501, or is interrupted. Then, a heater control signal S2 for turning on/off LE is supplied from the engine control circuit 70 to the power supply device 302, and a temperature signal detected by a thermistor 37*b* provided in the fixing apparatus 37 is supplied to the engine control circuit 70.

A cover switch 303 is turned off if a top cover of the main body 1 or a side surface cover is operated to be rotated (released). Therefore, since power supply voltage of +24V is interrupted by the switch 303 in a state that the top cover or the side surface cover is opened, the operations of the semiconductor laser 90, the mirror motor 16, the high voltage power supply 305, the main motor 307, the respective solenoids 308 to 311, the cooling fan 616, and the heater lamp 501 are stopped, so that no trouble occurs even if the operator touches the inside of the main body 1.

Figure 5:
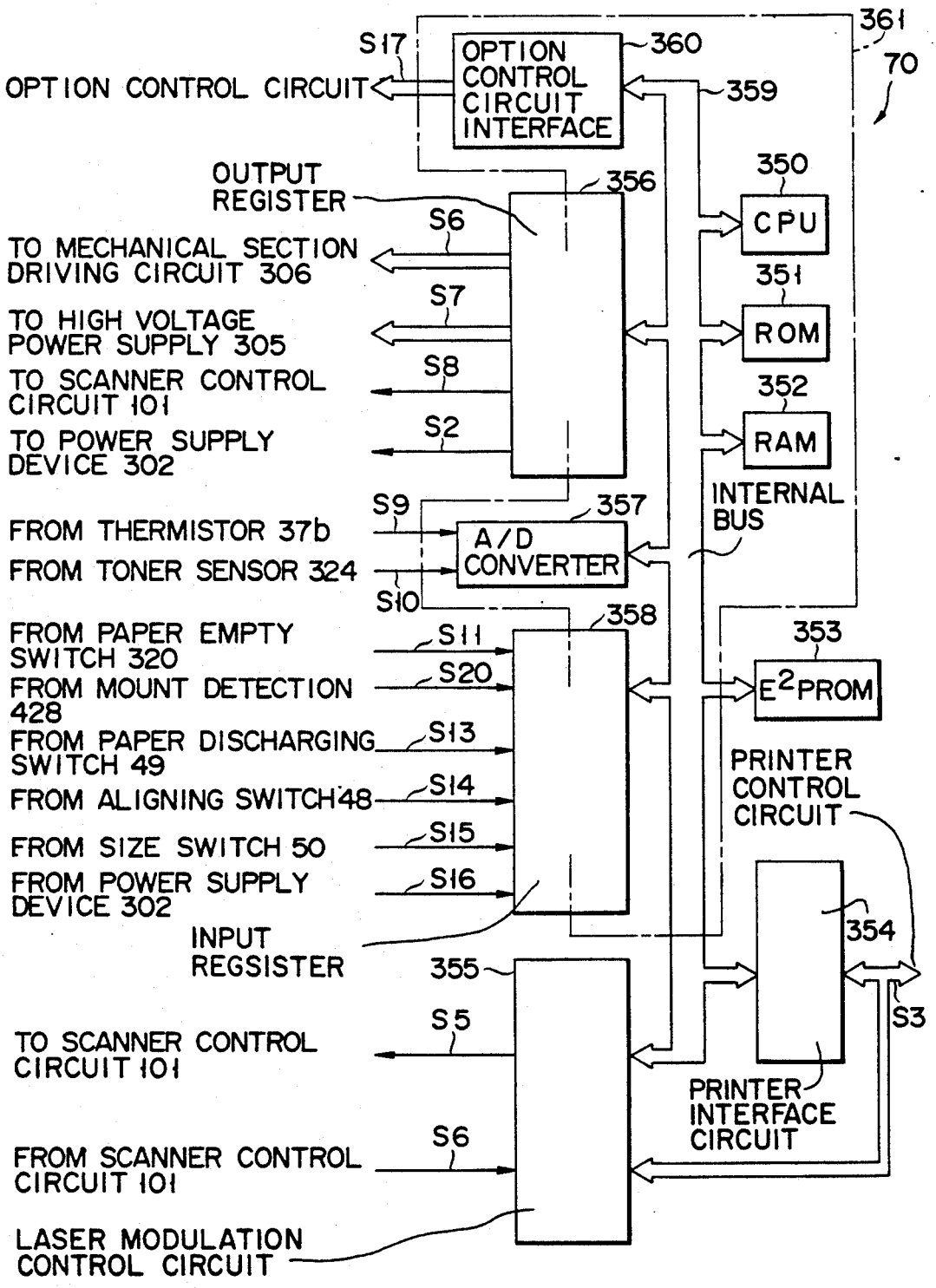
FIG. 5 is a block diagram showing the structure of an engine control circuit.

FIG. 5 shows the engine control circuit 70.

In the drawing a CPU (Central Processing Unit) 350 controls the entire engine control section 300, and is operated in accordance with a control program stored in ROM 351.

RAM 352 is used as a working buffer for the CPU 350.

In $E^2$PROM 353, there are stored the total number of papers to be printed, the number of papers to be used in the electronic photo process unit 60, that is, the total number of papers to be printed after the electronic photo process unit 60 is replaced with new one.

A printer interface circuit 354 receives and transmits an interface signal S3 between the printer control circuit 71 and the printer interface circuit 354.

A laser modulation control circuit 355 controls the semiconductor laser 90, periodically forcing it to be turned on in order to generate a laser beam detection signal S4 (to be explained later). Moreover, the laser modulation control circuit 355 modulation-controls the semiconductor laser 90 in accordance with image data, which is sent from the printer control circuit 71 by the interface signal S3, and outputs a laser modulation signal S5 to the scanner control circuit 101.

An output register 356 outputs control signals S6, S7, S8 and S2, which respectively control the mechanical section driving circuit 306, the high voltage power supply 305, the scanner control circuit 101, and the heater lamp driving circuit.

In an A/D converter 357, there are inputted voltage signals S9 and S10, which are generated by the thermistor 37*b* and the toner sensor 324. The voltage values are converted into digital values.

In an input register 358, there are inputted state signals S11, S13, S14, S15, S20, which are respectively sent from a paper empty switch 320, the paper discharging switch 49, the aligning switch 48, a size switch 50, and the mount detection 428, and a state signal S16 wherein the power supply voltage of +24V is turned on/off.

An option control circuit interface 360 receives and transmits an interface signal S17 between an option control circuit (not shown) and the option control circuit interface 360.

An internal bus 359 mutually receives and transmits data and the control signals between the CPU 350, the ROM 351, the RAM 352, the $E^2$PROM 353, the printer interface circuit 354, the laser modulation control circuit 355, the output register 356, the A/D converter 357, and the input register 358.

The present invention can be realized by use of CPU 350, ROM 351, RAM 352, A/D converter 357, option control circuit interface 360, and the output register 360 part of the input register 358, and one-chip micro computer 361.

In the mechanical section driving circuit 306, there is provided a driving circuit for driving various types of motors and solenoids. The on/off operation of the driving circuit is controlled by the binary control signal S6 outputted from the output register 356. In other words, the various driving circuits are turned on when the signal is "1", and off when the signal is "0", and the +24V power supply is supplied to the pre-exposing apparatus 21, the main motor 307, the solenoids 308 to 311 or interrupted.

In the scanner control circuit 101, there are provided the semiconductor laser 90 and the driving circuit of the mirror motor 16. The on/off operation of the semiconductor laser 9 is controlled by the laser modulation signal S5 outputted from the laser modulation control circuit 355. The on/off operation of the mirror motor 16 is controlled by the control signal S8 outputted from the output register 356. Moreover, a laser beam detection sensor 312 is a PIN diode. The laser beam detection sensor 312 detects the passage of the laser beam and sends the detected laser beam to the laser modulation control circuit 355 a the laser detection signal S4. The respective high voltage signals S20, S22, S24 of the developing bias, charging, and transferring are outputted to the developing apparatus 19, the charging apparatus 18, and the transferring apparatus 20 from the high voltage power supply 305. The on/off operations of these apparatuses are controlled by a "0" or "1" of the control signal S7 outputted from the output register 356.

As mentioned above, in the engine control section 300, power is supplied to each electric circuit via the engine control circuit 70, and each section is controlled by the binary control signal outputted from the engine control circuit 70. Then, the engine control section 300 and a printer control section (to be explained later) are coupled to each other by the interface signal S3.

The structure of the printer control section will be explained.

Figure 6:
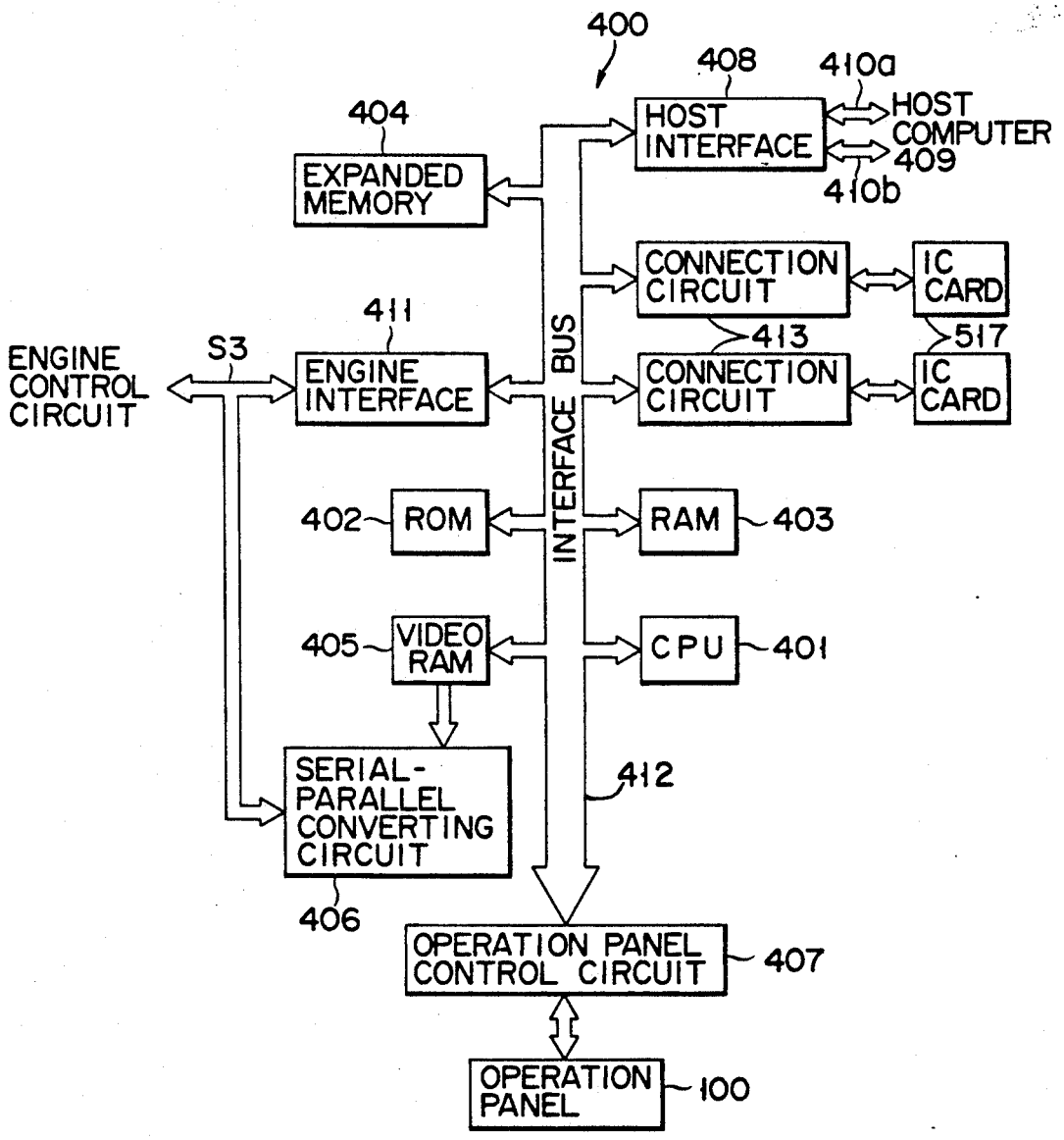
FIG. 6 is a block diagram showing the structure of a printer controlling section.

FIG. 6 shows the structure of the main part of a printer control section 400.

In the drawing, a CPU 401 controls the whole printer control section 400.

A ROM 402 stores a control program, and the CPU 401 executes the program. In the ROM 402 is stored data relating to paper P, such as code number, which is collated at the time of changing data, top margin, left margin and, paper type.

A RAM 403 is used as a page buffer for temporarily storing image data, which is sent from a host computer 409, and used as a working buffer for the CPU 401.

An expanded memory 404 is a large capacity memory which is used where data for one page cannot be stored in the RAM 403, since image data, which is sent from a host computer 409, includes a large capacity of data, such as bit map data.

A video RAM 405 stores image data which is expanded to a bit image, and the output thereof is supplied to a serial-parallel conversion circuit 406.

The serial-parallel conversion circuit 406 converts the image data, which is sent from the video RAM 405 as parallel data, into a serial data, and sends it to the engine control circuit.

A host interface 408 receives and transmits data between the host computer 409, which comprises an electronic computer and an image reading apparatus, and the printer control section 400, and has a serial transferring line 410*a* and a parallel transferring line 410*b*. The serial transferring line 410*a* and the parallel transferring line 410*b* are selectively used in accordance with the type of data to be transferred between the host computer 409 and the printer control section 400.

An engine interface 411 receives and transmits the interface signal S3 between the printer control circuit 71 and the engine control circuit 70.

A connection circuit 413 interrupts power to be supplied to an IC card and a signal line, and prevents data stored in the IC card 517 from being destroyed by noise generated in extracting, where the IC card 517 is inserted into or extracted from the connector.

An operation panel control circuit 407 controls the displaying of a guide message on a liquid crystal display in the operation panel 100, control of turning on or off of the LED display, blinking of the LED display, and control of sending data input from the switch on the panel 100 to the CPU 401.

An internal bus 412 receives and transmitting data among the CPU 401, ROM 402, RAM 403, expanded memory 404, video RAM 405, operation panel control circuit 407, host interface 408, engine interface 411 and connection circuits 413, 413.

The IC card 517 comprises a non-volatile memory, such as a static RAM with a battery backup, an $E^2$-PROM, an EPROM, or a mask ROM, and functions as a font card.

Control of the pre-exposing or discharging apparatus 21 and the mount detection of the electronic photo process unit 60 will be explained.

Figure 7:
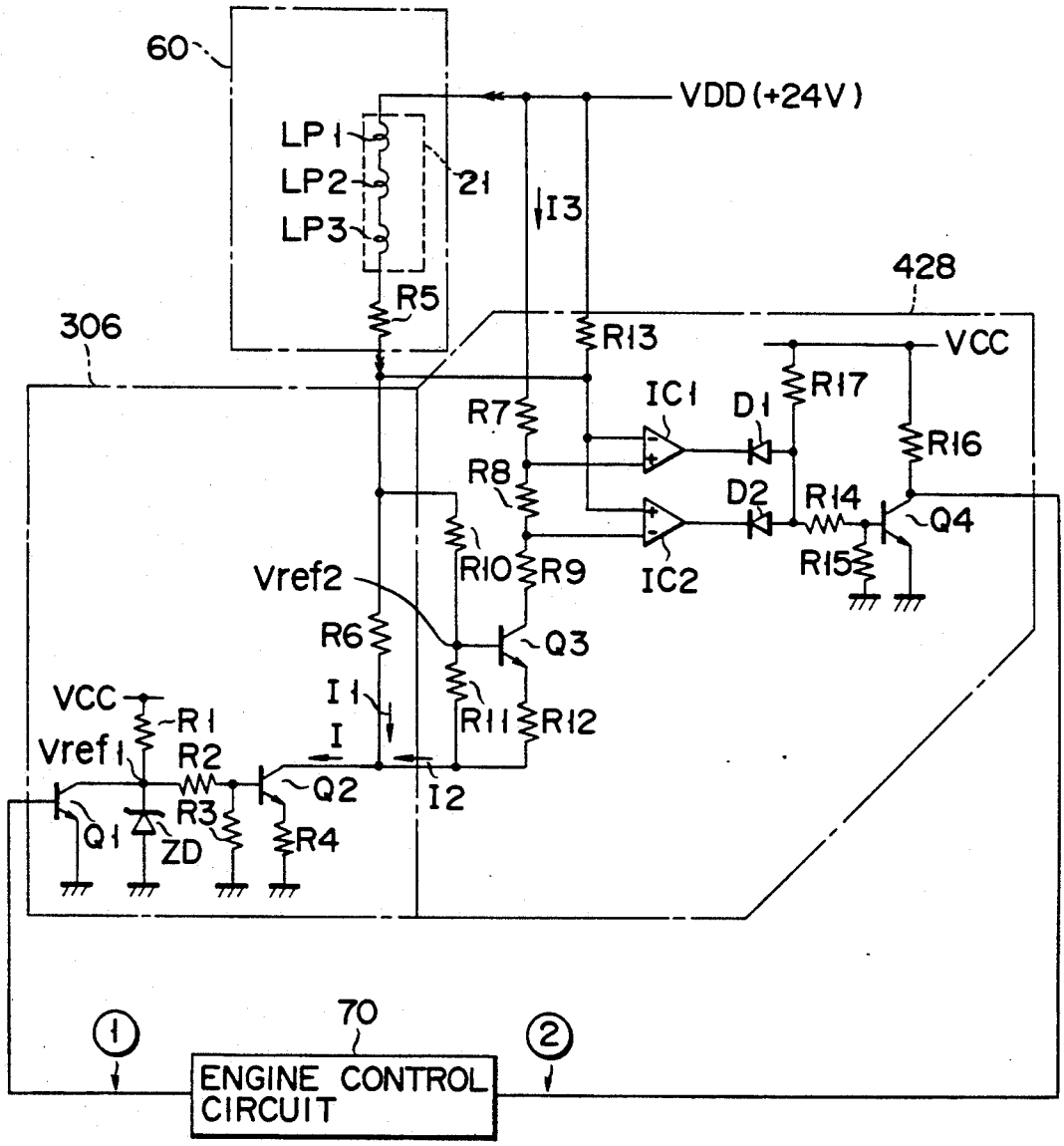
FIG. 7 schematically shows the structure of a driving circuit of a pre-exposing apparatus and the structure of a mount detecting circuit.

FIG. 7 schematically shows the driving circuit of the pre-exposing apparatus 21, and that of mount detection circuit 428. In the drawing, LP1 to LP3 are tungsten lamps constituting the preexposing apparatus 21. These lamps are turned on by a lamp driving circuit in the mechanical section driving circuit 306 when the output signal ① (signal S6) is "1."

Comparators or OP amplifiers $IC_1$ and $IC_2$ in the mount detection circuit 428 detects a drop voltage in resistor 5 and the lamps LP1 to LP3 provided in the electronic photo process unit 60. The mount detection circuit 428 supplies the signal ② (signal S 20), which is used to discriminate whether or not the electronic photo process unit 60 and the main body are matched, to the engine control circuit 70.

As shown in FIG. 7, in the mechanical section driving circuit 306, the lamp driving circuit comprises transistors Q1, Q2, resistors R1 to R4 and R6, and a Zener diode ZD. The current flowing in the resistors R to R13 is much smaller than the current flowing in the tungsten lamps LP1 to LP3. Therefore, it can be understood that driving current $I_1$ flowing in the resistor 6 and the current flowing in the tungsten lamps LP1 to LP3 are equal to each other. In this case, a combined current I of the driving current $I_1$ flowing in the tungsten lamps LP1 to LP3 and the current $I_2$ flowing the detection circuit, which comprises the resistors R7 to R13 and the transistor Q3, is proportional to a reference voltage $V_{ref1}$, which is determined by the Zener diode ZD. Therefore, if the values of the resistors R5 to R13 are fixed values, a constant current, which is determined by the reference voltage $V_{ref1}$, flows in the tungsten lamps LP1 to LP3. The current $I_1$ does not change even if a lamp driving voltage $V_{DD}$ varies. Thus, the lamp driving circuit is constant current generator.

As mentioned above, by use of the driving circuit 306, the constant lamp current can be supplied to the tungsten lamps LP1 to LP3. Therefore, since this can prevent a rush current when the tungsten lamps LP1 to LP3 are not heated, stable operation of the preexposing apparatus 21 can be ensured.

As mentioned above, there is provided the preexposing apparatus 21, which comprises tungsten lamps LP1 to LP3, in the electronic photo unit 60. Therefore, the current $I_1$ flowing in the resistor R6 is detected, thereby making it possible to detect the presence/nonpresence of the electronic photo process unit, that is, whether or not the electronic photo process unit 60 is mounted on the main body 1.

As shown in FIG. 7, the mount detection circuit 428 comprises comparators IC1, IC2, diodes D1, D2, transistor Q4, and resistors R14 to R17. In this case, the resistance values of the respective resistors R7 to R13 for the mount detection are set to be sufficiently larger than those of the resistors R5 and R6.

Figure 8:
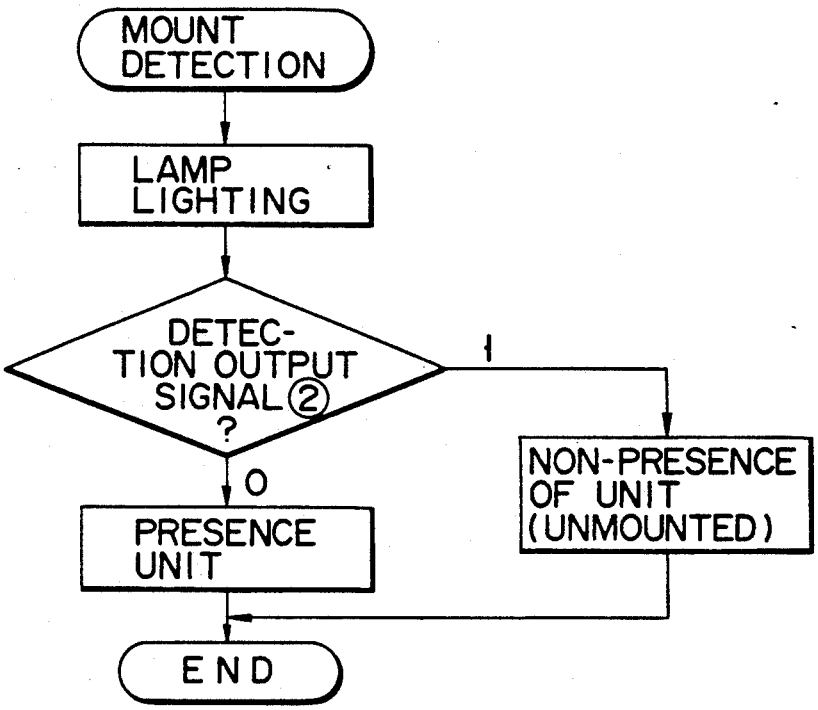
FIG. 8 is a flow chart explaining the outline of the mount detecting operation.

Regarding the mount detection of the electronic photo process unit 60, when the tungsten lamps LP1 to LP3 of the pre-exposing apparatus 21 are turned on, the engine control circuit 70 inputs the detection output ② from the mount detection circuit 428 and the detection output is discriminated, thereby the mount detection of the electronic photo process unit 60 is performed. FIG. 8 shows the mount detection operation of the electronic photo process unit 60 in the engine control circuit 70.

Consider a case in which the electronic photo process unit 60 is not mounted on the main body 1. For example, Assuming that "0" as an output signal ① is outputted and, the transistor Q2 of the lamp driving circuit is turned on. At this time, the transistor Q2 is in a sufficient saturation state since current I to be supplied is small.

Moreover, current I, which flows in the resistor R6, is small, and a reference voltage $V_{ref2}$, which is generated by the voltage drop of the resistor R6, cannot drive the transistor Q3. Therefore, reference voltages of the comparators IC1 and IC2 (voltages of both ends of resistor R8) become the lamp driving circuit $V_{DD}$ itself, and the output of the comparator $IC_2$ becomes "0" and that of the comparator IC1 becomes "1." In this case, since the AND circuit, which is formed of the diodes D1 and D2, is not established, the off state of the transistor Q4 is left as it is, and the detection output signal ②, which is the input of the engine control circuit 70, is $V_{CC}$, that is, "1."

The engine control circuit 70 determines that the electronic photo process unit 60 is mounted when the detection output signal 2 is "0." Due to this, as mentioned above, when the detection output signal is (2) is "1", the engine control circuit 70 determines that the electronic photo process unit 60 is not mounted.

Next is explained the case in which the electronic photo process unit 60 is mounted on the main body 1. In this case, the transistor Q2 is in an nonsaturation state, and the constant current I flows therein. The current $I_1$ flowing in the resistor R6 is sufficiently large, and the transistor Q3 is turned on by the reference voltage $V_{ref2}$, which is obtained by the voltage drop of the resistor R6 Thereby, the current $I_3$ flowing in the resistors R7, R8, R9 becomes the constant current. In other words, since the current I flowing in the resistor R6 is the constant current and the reference voltage $V_{ref2}$ is the constant voltage, the current $I_3$ flowing in the resistors R7, R8, R9 is also the constant current.

As shown in the figure, the voltages of the respective contact points of the resistors R7, R8, R9 are noninverting input and inverting input for the comparators IC1 and IC2, respectively, and the other inputs are connected in common to the voltage drop point of the resistor R13. Due to this, the outputs of both comparators IC1 and IC2 become "1." As a result, the engine control circuit 70 determines that the suitable electronic photo process unit 60 is mounted. The suitable range of the voltage dropped by the tungsten lamps LP1 to LP3 and the resistor R5 from the lamp driving voltage $V_{DD}$ is as follows:

$$I_3 \cdot R7 < I_1 \cdot R5 < I_3 \cdot (R7 + R8) \quad \ldots (1)$$

where the relationship between resistor R13 and resistor 5 is R13>>R5.

As mentioned above, the driving current $I_1$, which flows when the tungsten lamps LP1 to LP3 of the preexposing apparatus 21 are turned on, is detected, thereby determining the presence or non-presence of mounting the electronic photo process unit 60 onto the main body 1, or the suitability of the process unit 60 for the main body 1.

Figure 9:
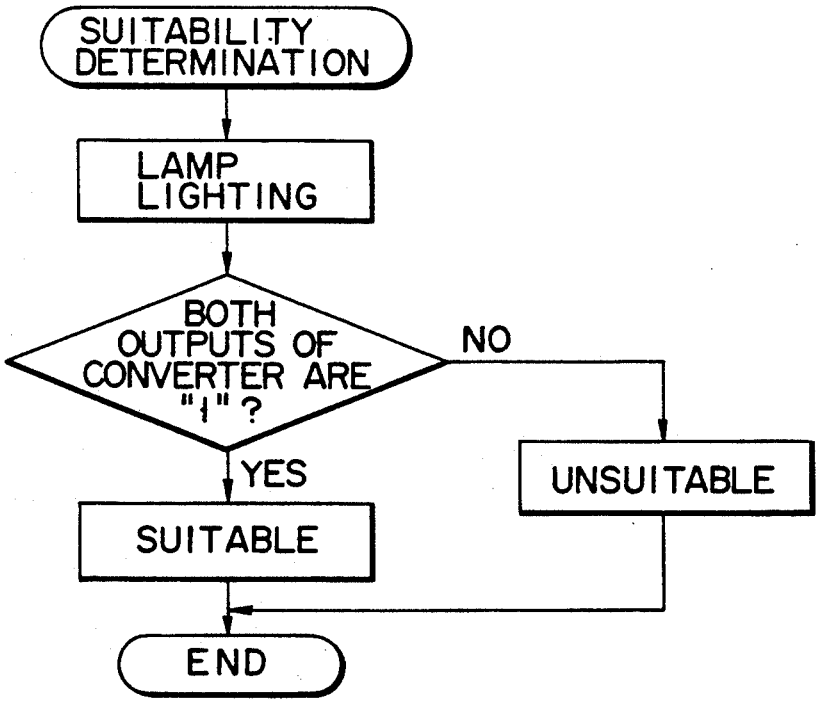
FIG. 9 is a flow chart for explaining an operation for discriminating suitability in the present invention.

Moreover, the resistance value of resistor R5 in the pre-exposing apparatus 21 and the resistance values of the resistors R7 to R9 are differently set, depending on the type of apparatus. Thereby, the electronic photo process unit, which is suitable for the main body 1, can be defined. For example, each resistance value excepting the resistor R7 in the main body is set to be same in all types of apparatus and the resistor R7 and the resistor R5 in the process unit are selectively set for a specific type of apparatus, thereby a specific process unit, which is suitable for the specific type of apparatus, can be defined. In other words, the values of these resistors R7, and R5 are varied, depending on the type of apparatus, this makes it possible to easily determine the suitability of the electronic photo process unit 60 for the main body 1. Additionally, FIG. 9 shows the operation relating to the determination of the above-mentioned suitability.

As is understood from the above explanation, according to the present invention, the voltage drop, which is caused by the resistors inserted in series in the pre-exposing apparatus, is detected, thereby determining the suitability of the electronic photo process unit for the main body. Therefore, since there is no use of special mechanical connection parts and the special switch in determining the suitability of the process unit for the main body, the manufacturing cost can be reduced. Moreover, since a constant current is used in the pre-exposing apparatus, there can be overcome the problem in which unfavorable influence is exerted on the other components in the process unit, such as the photosensitive drum.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus for performing an image forming operation to form an image on an image carrier member, said image forming apparatus comprising:

a process unit detachably mounted on said image forming apparatus, said process unit having said image carrier member and discharging means for discharging a surface of said image carrier member;

means for supplying a driving current for driving said discharging means;

means for detecting the driving current supplied to said discharging means by said supply means; and means for determining that said process unit is mounted on said image forming apparatus when said detecting means detects that said driving current is supplied from said supply means to said discharging means.

2. The image forming apparatus according to claim 1, wherein said process unit includes means for dropping a voltage of the driving current supplied by said supply means for driving said discharging means, and said detecting means includes means for detecting the voltage dropped by said dropping means.

3. An image forming apparatus for performing an image forming operation to form an image on an image carrier member, said image forming apparatus comprising:

a process unit, detachably mounted on said image forming apparatus, said process unit having said image carrier member and discharging means for discharging a surface of said image carrier member;

means for driving said discharging means by a constant current;

means, provided on said process unit for dropping a voltage of the constant current driven by said driving means for driving said discharging means;

means for detecting the voltage dropped by said means for dropping the voltage; and means for determining suitability of said process unit mounted on said image forming apparatus for said image forming apparatus, based on the detection by said detection means.

4. The image forming apparatus according to claim 3, wherein said means for dropping a voltage includes voltage drop resisting means connected in series between said discharging means and said driving means.

5. The image forming apparatus according to claim 4, wherein said driving means includes:

a predetermined voltage generation resistor, in which said constant current flows and which is connected in series to said voltage drop resisting means, for supplying a predetermined voltage to said detecting means.

6. The image forming apparatus according to claim 5, wherein said detecting means includes means for generating a current proportional to said predetermined voltage supplied by said predetermined voltage generation resistor, and means, in which said proportional current flows, for providing an allowable range of the voltage dropped by said voltage dropping means, said range representing a suitable range of the process unit for said main body, and wherein said detecting means discriminates that the process unit, being connected to said main body, is suitable for said main body when said dropped voltage is in the allowable range.

7. An image forming apparatus for performing an image forming operation to form an image on an image carrier member, said image forming apparatus comprising:

a process unit, detachably mounted on said image forming apparatus, said process unit having said image carrier member and pre-exposing means exerting an electrical function on said image carrier member;

means for electrically driving said pre-exposing means;

means for detecting a drop voltage of a predetermined resistor in which a drive current of said preexposing means flows; and means for determining whether or not said process unit is mounted to said image forming apparatus, and said process unit is suitable for said image forming apparatus, based on the output from said detecting means.

8. The image forming apparatus according to claim 7, wherein said driving means includes a constant-current generator generating a predetermined current.

* * * * *